United States Patent [19]

Holloway et al.

[11] Patent Number: 4,781,643

[45] Date of Patent: Nov. 1, 1988

[54] TODDLER TREE

[76] Inventors: Donna L. Holloway; Teryl L. Olson, both of 4993 August Dr., Carson City, Nev. 89701

[21] Appl. No.: 139,821

[22] Filed: Dec. 30, 1987

[51] Int. Cl.[4] ..... A63H 3/52

[52] U.S. Cl. ..... 446/75; 446/476; 446/418

[58] Field of Search ..... 446/71, 74, 75, 177, 446/227, 418, 476, 477, 479, 480, 482; 220/D13; 206/423, 457, 817, 829; 428/17, 18, 19, 20; D21/115; 47/45, 66

[56] References Cited

U.S. PATENT DOCUMENTS

| | | | |
|---|---|---|---|
| D. 241,961 | 10/1976 | Bollinger | D21/115 |
| D. 254,678 | 4/1980 | Holden et al. | D21/115 |
| D. 280,999 | 10/1985 | Cavnar | D21/115 |
| D. 287,740 | 1/1987 | Orenstein | D21/115 |
| 2,166,002 | 7/1939 | Fritsch | 428/18 |
| 2,189,853 | 2/1940 | Zadek | 446/177 |
| 2,774,183 | 12/1956 | Montgomery | 446/418 |
| 3,290,817 | 12/1966 | Kravath | 446/227 |
| 4,386,480 | 6/1983 | Horowitz | 47/45 |

*Primary Examiner*—Robert A. Hafer
*Assistant Examiner*—Michael Brown
*Attorney, Agent, or Firm*—Jerry T. Kearns

[57] ABSTRACT

A toy tree for use as a toy box and an amusement device for small children has a hollow trunk and a removable lid. Openings in the side of the hollow trunk are connected to enclosed chutes which have bells which ring when toys are inserted through the side openings. The toy tree has a weighted suction base for stability. Various assorted toys are suspended from the top of the tree.

16 Claims, 4 Drawing Sheets

TODDLER TREE

BACKGROUND OF THE INVENTION

1. Field of the Invention

The present invention relates to toy trees, and more particularly pertains to a new and improved toy tree which is hollow for use as a toy box, and which has various toys for the amusement of small children suspended therefrom.

2. Description of the Prior Art

Various types of artificial and toy tree devices are known in the prior art. One example of an artificial tree construction may be found in U.S. Pat. No. 206,387, which issued to F. Bowen on July 30, 1878. This patent discloses attaching arrangements for securing artificial branches and leaves to an artificial stalk. U.S. Pat. No. 1,636,981, which issued to H. Berman on July 26, 1927, discloses an artificial Christmas tree constructed of a frame having artificial branches in the form of a continuous rope which is wound in a conical coil. U.S. Pat. No. 1,997,446, which issued to L. Bigelow on Apr. 9, 1935, discloses an artificial illuminated toy tree. U.S. Pat. No. 3,940,877, which issued to J. Culkin on Mar. 2, 1976, discloses a construction for an artificial tree in which soft stuffed fabric materials are utilized. U.S. Pat. No. 4,543,278, which issued to G. Ackerman on Sept. 24, 1985, discloses a two dimensional flat tree for hanging on a wall. Various toys may be attached to this wall hanging by a VELCRO material. However, none of these prior art artificial trees are hollow and none of them are suitable for use as a toy box by small children. A further disadvantage of the aforesaid prior art toy trees is a lack of a stable supporting base.

SUMMARY OF THE INVENTION

In view of the foregoing disadvantages inherent in the known types of toy trees now present in the prior art, the present invention provides an improved toy tree. As such, the general purpose of the present invention, which will be described subsequently in greater detail, is to provide a new and improved toy tree which has all the advantages of the prior art toy trees and none of the disadvantages.

To attain this, a representative embodiment of the concepts of the present invention is illustrated in the drawings and makes use of a hollow trunk portion supported by a weighted suction base. A removable lid having handles designed for use by small children is also provided. Additionally, side openings are provided in the hollow trunk portion which are in communication with enclosed chutes formed on the interior of the hollow trunk. Bells are received in the enclosed chutes and ring when toys are inserted through the side openings. It is further contemplated that various additional toys for the amusement of small children may be suspended from the top portion of the toy tree.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy tree which has all the advantages of the prior art toy trees and none of the disadvantages.

It is another object of the present invention to provide a new and improved toy tree which may be easily and efficiently manufactured and marketed.

It is a further object of the present invention to provide a new and improved toy tree which is of a durable and reliable construction.

An even further object of the present invention is to provide a new and improved toy tree which is susceptible of a low cost of manufacture with regard to both materials and labor, and which accordingly is then susceptible of low prices of sale to the consuming public, thereby making such toy trees economically available to the buying public.

Still yet another object of the present invention is to provide a new and improved toy tree which provides in the apparatuses and methods of the prior art some of the advantages thereof, while simultaneously overcoming some of the disadvantages normally associated therewith.

Still another object of the present invention is to provide a new and improved toy tree having a hollow trunk portion and a removable lid whereby the toy tree may be utilized as a toy box.

Yet another object of the present invention is to provide a new and improved toy tree which has a stable weighted suction base.

Even still another object of the present invention is to provide a new and improved toy tree in which enclosed chutes having bells received therein are provided.

Yet again another object of the present invention is to provide a new and improved toy tree having diverse toys suspended therefrom for the amusement of small children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
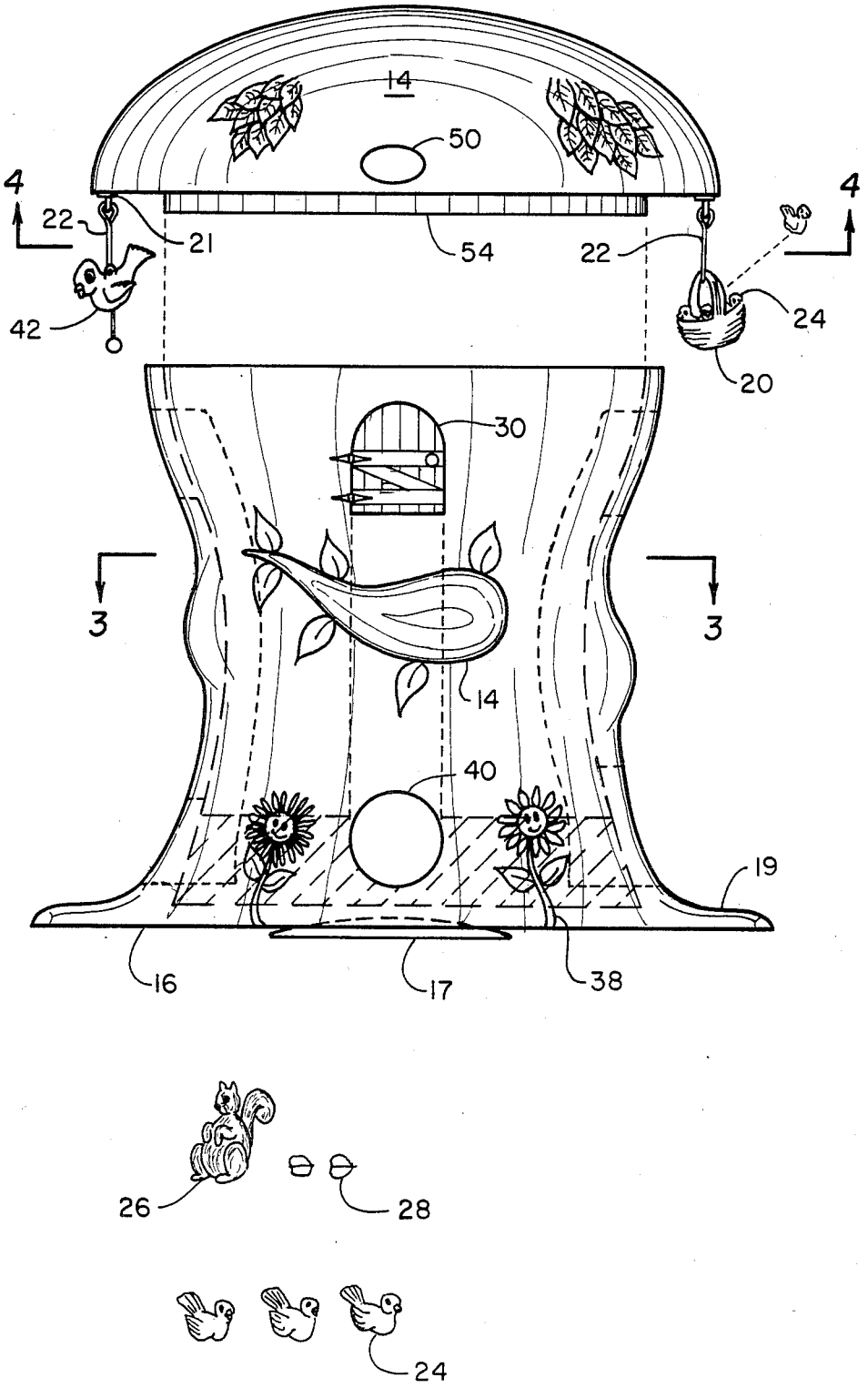
FIG. 1 is a front perspective view of the toy tree of the present invention.

With reference now to the drawings, and in particular to FIG. 1 thereof, a new and improved toy tree embodying the principles and concepts of the present invention and generally designated by the reference numeral 10 will be described.

More specifically, it will be noted that the first embodiment 10 of the invention includes a hollow trunk portion 12, preferably formed of a brown colored molded plastic material, which is connected to a weighted base 16, which has a centrally disposed ten to twelve inch diameter suction cup to hold the toy tree on smooth floor surfaces. The base 16 has four radially outwardly extending tree root portions 19, which are circumferentially spaced about the base 16 at equal, ninety degree intervals. Base 16 may be given sufficient weight for stabilizing the toy tree by constructing the bottom four inches of the trunk portion of solid plastic. Alternatively, a nontoxic material such as sand, may be sealed within the base portion during manufacture. A removable lid 14, preferably formed of a green molded plastic material to resemble natural tree leaves, covers the top of hollow trunk portion 12. Branches 14, of which any desired number may be provided, are molded to sides of the trunk portion 12, and do not extend outwardly. These branches are likewise formed to resemble natural tree branches. Various assorted toys for the amusement of small children may be provided. These toys are suspended from hooks 21 on the underside of the lid 14 by attaching cords 22. These cords may be plastic bands or any other material sufficiently strong so as to be incapable of being removed by small children. Several preferred forms of suspended toys are illustrated, one example is a nest 20 in which a plurality of birds 24 are removably received. A squirrel 26, along with nuts 28 are received in a side opening in the trunk 12 behind upper door 30. A plurality of flowers 38 are distributed around the lower portion of the base 16. These flowers 38 are molded into the base unit and do not extend outwardly. A lower hole 40 for reception of small artificial animals is also provided. A hanging bird 42 is securely affixed to the underside of the lid 14 by another attaching cord 22. The bird is preferably constructed so as to flap his wings and chirp when the illustrated pull string is actuated. A metal mirror 44 is affixed to the upper trunk portion 12 on the side of the trunk opposite to the hanging bird 42.

Figure 2:
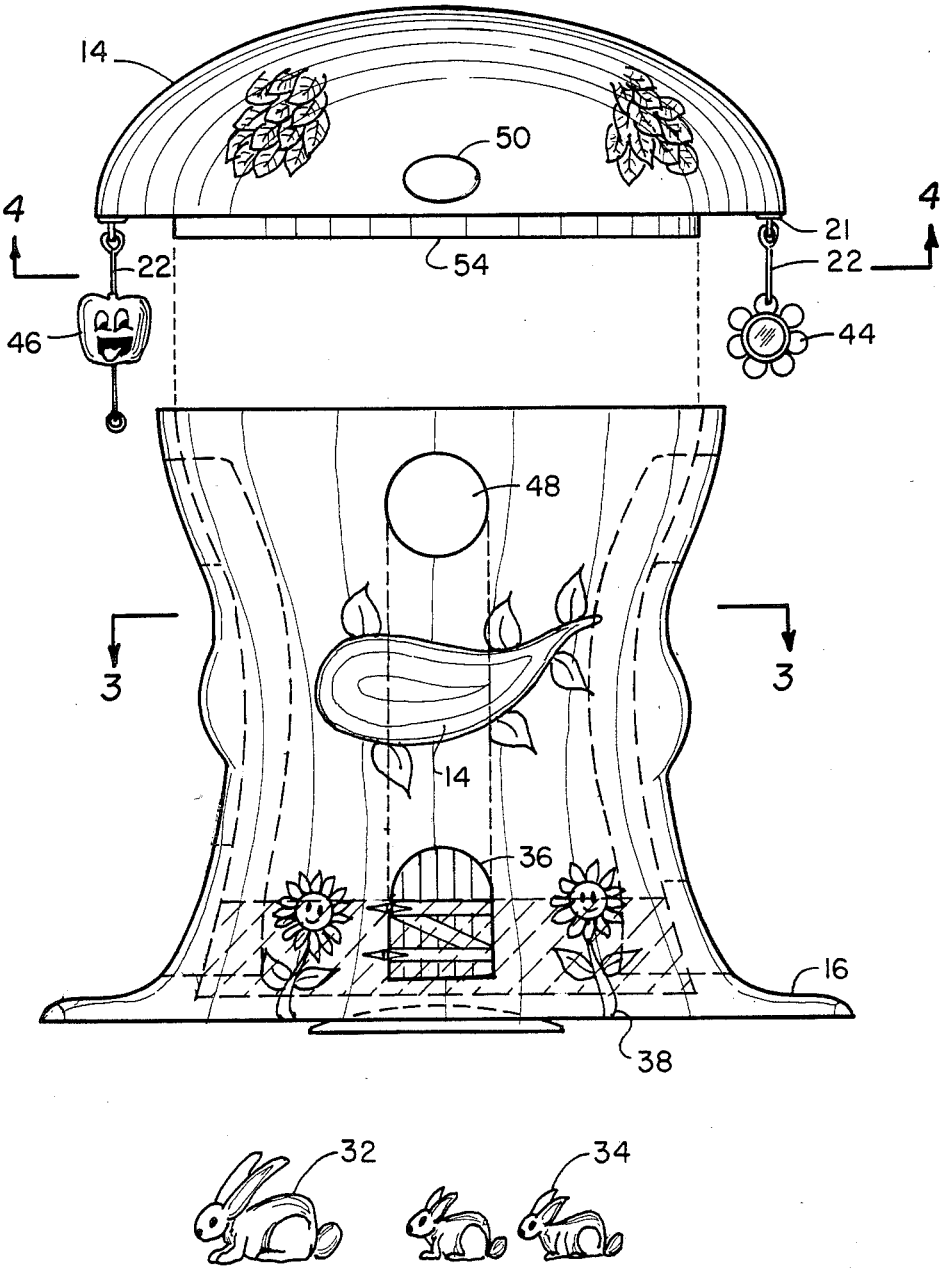
FIG. 2 is a perspective view of the back of the toy tree of the present invention.

As shown in FIG. 2, at the back of the toy tree, an apple 46 is suspended from the underside of the lid 14 on the opposite side of the tree as a flower shaped metal mirror 44. The toy apple 46 is preferably constructed so that upon actuation of the illustrated pull string the apple rolls his eyes and sticks out his tongue. An upper hole 48 is provided at the back of the toy tree intermediate the apple 46 and the metal mirror 44. This hole is utilized for the reception of various small toys. A mother rabbit 32 and a plurality of baby bunnies 34 are received in an opening behind lower door 36.

The above noted examples serve to illustrate various toys which may be associated with the toy tree of the instant invention, and it is apparent that a multitude of other toys may be substituted for those which have been illustrated without departing from the intended scope of the invention. It is contemplated that the leaves on the tree and the flowers may be molded in a variety of different colors, for example, green, red, blue and yellow.

As previously mentioned, lid 14 is removably received on top of the trunk portion 12. The lid 14 is provided with handles 50 designed to enable small children to pull themselves to a standing position. The toy tree of the instant invention is preferably constructed from molded plastic material, and all of elements are provided with rounded edges for the safety of the small children.

Figure 3:
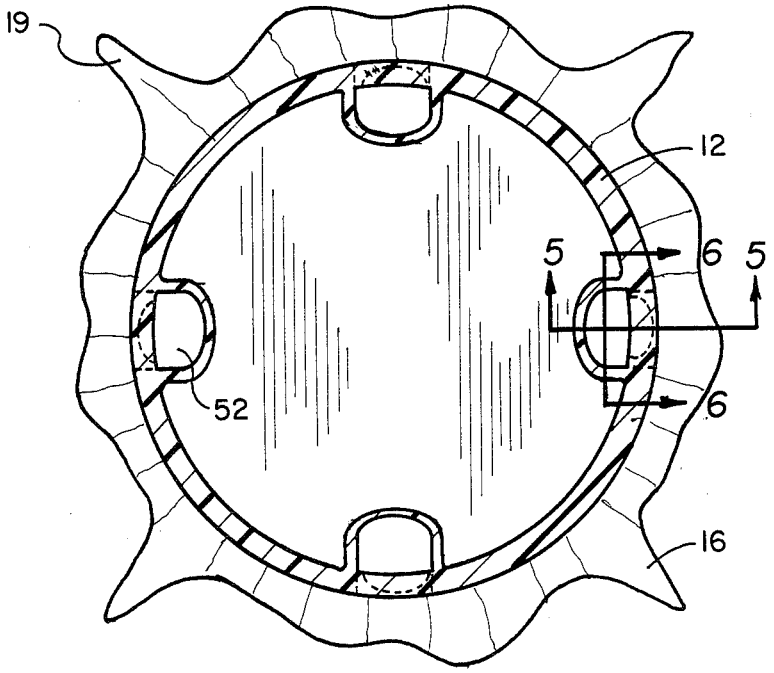
FIG. 3 is a cross sectional view taken along line 3—3 of FIG. 1, illustrating the interior of the hollow trunk of the toy tree.

With reference now to FIG. 3, a cross sectional view looking downwardly into the hollow trunk portion 12 is provided. Four enclosed chutes 52, which are in communication with the upper openings extending through the sidewalls of the hollow trunk 12, have bells received therein. The four chutes are circumferentially spaced at equal ninety degree intervals around the trunk 12, with each chute 52 positioned intermediate a pair of roots 19. The bells are suspended in the enclosed chutes so as to ring when toys are inserted through the side openings of the trunk portion 12. As is now apparent, the chutes 52 open only exteriorly of the tree. Children insert toys into the top of chutes 52, which causes the bells to ring before the toys fall out the bottom holes of the chutes and onto the floor. The bells are received in the chutes 52 in such a manner as to be inaccessible to the hands of the small children.

Figure 4:
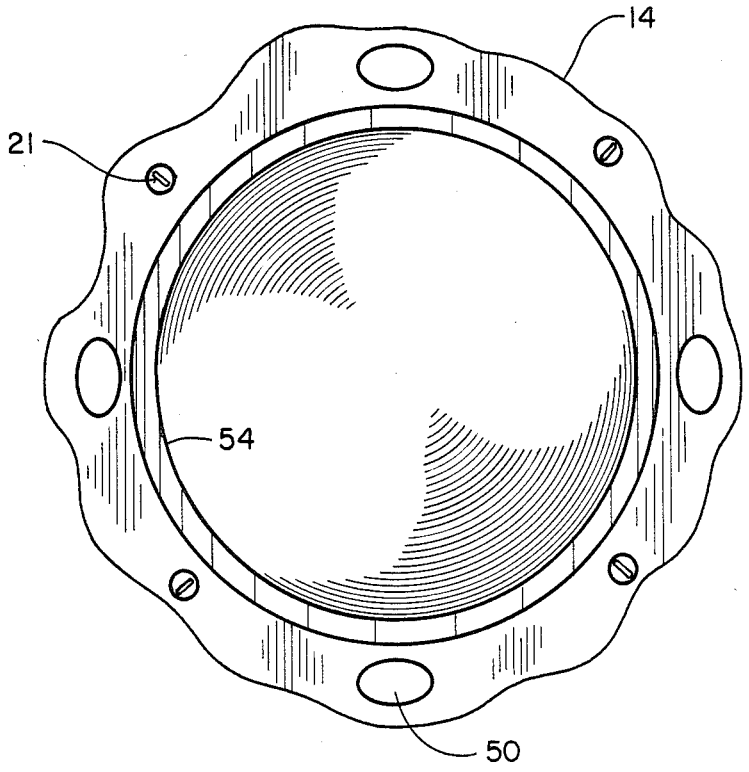
FIG. 4 is a view of the underside of the lid of the toy tree.

With reference now to FIG. 4, it may be seen that the lid 14 has a circular lip 54 extending from the bottom thereof. This lip 54 fits just inside the top opening of the hollow trunk portion 12, and serves to removably secure the lid 14 on the trunk portion 12. A plurality of handles 50 are distributed around the circumference of the lid 14. These handles are formed with integrally molded rounded edges so as to be safe for grasping by small children. These handles serve two purposes; firstly, they enable children to pull themselves to an upright position and secondly, they are utilized to remove lid 14 from the top of trunk portion 12. As previously described, a plurality of hooks 21 are circumferentially spaced about the underside of the lid 14. These hooks 21 are for the purpose of suspending the aforesaid toys from the top portion of the tree.

Figure 5:
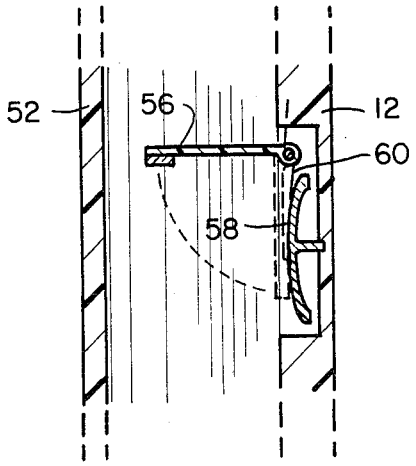
FIG. 5 is a cross sectional view taken along line 5—5 of FIG. 3, illustrating the chute bell mechanism.

In the cross sectional detail view of FIG. 5, the details of the chute bell mechanisms are illustrated. A bell clapper 56 is pivotally mounted adjacent a bell 58 mounted in an interior recess in the trunk 12 which is enclosed by the chute 52. The clapper 56 is biased to the illustrated position, in which it extends transversely across the chute 52, by a spring 60.

Figure 6:
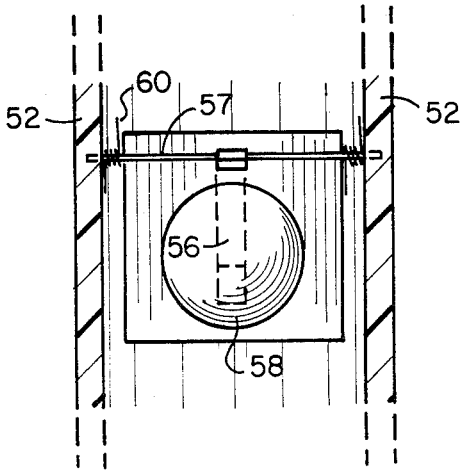
FIG. 6 is a cross sectional view taken along line 6—6 of FIG. 3, illustrating the chute bell mechanism.

As shown in FIG. 6, the clapper 56 is mounted on a rod 57, which is pivotally mounted adjacent the bell 58. The springs 60 serve to bias the clapper 56 to the position illustrated in FIG. 5, in which the clapper 56 blocks the chute 52. When a toy is dropped into the top of the chute 52, the toy strikes the clapper 56 and drives it into contact with the bell 58, thus ringing the bell. After passage of the toy out of the chute 52 and onto the floor, the clapper is returned to its original position by the springs 60.

Thus, it can be seen, that the present invention provides a toy tree for the amusement of small children and also serves as a toy box for the reception of their toys. The various disclosed small animals are small enough to be received through the side openings in the trunk portion 12, but are not small enough to be swallowed by small children. The preferred size of the toy tree of the present invention is a height of twenty to twenty four inches and a diameter of fourteen to fifteen inches. This size has been found to be suitable for use by small children. The toy tree is preferably constructed of a tough molded non-toxic plastic material, as are the small animals and toys suspended from the trunk portion. While one form of chute bell mechanism has been described, a variety of other forms of bells may be utilized without departing from the spirit and scope of the present invention. For example, small bells with internal clappers may be suspended in the chutes 52.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved toy tree, for use as a toy box, comprising:

base means;

a hollow trunk means, having a top opening, connected to said base means;

a removable lid means covering said top opening;

at least one side opening means formed in said trunk means;

enclosed chute means in said hollow trunk means communicating with said side opening means; and bell means in said enclosed chute means, whereby toys inserted through said side openings means will fall into said chute means, ring said bell means and fall out onto a floor.

2. The toy tree of claim 1 further comprising lip means integrally formed on a bottom surface of said removable lid means for securing said lid means on said hollow trunk means, said lid means extending radially outwardly over said trunk means.

3. The new and improved toy tree of claim 1 further comprising door means connected to said trunk means for opening and closing said side opening means.

4. The toy tree of claim 1 further comprising integrally formed molded handle means formed in said removable lid means.

5. The toy tree of claim 1 further comprising suction means on said base means for securing said toy tree to smooth floor surfaces.

6. The toy tree of claim 5 further comprising weight means on said base means for stabilizing said toy tree.

7. The toy tree of claim 1 further comprising weight means on said base means for stabilizing said toy tree.

8. The toy tree of claim 1 further comprising at least one toy means suspended from said tree means.

9. The toy tree of claim 8 wherein said toy means comprises an apple.

10. The toy tree of claim 8 wherein said toy means comprises a hanging bird.

11. The toy tree of claim 8 wherein said toy means comprises flowers molded to sides of said trunk means.

12. The toy tree of claim 8 wherein said toy means comprises a bird nest having small toy birds removably received therein.

13. The toy tree of claim 8 wherein said toy means comprises a metal mirror.

14. The toy tree of claim 8 further comprising a plurality of small animals of a size to be received in said side opening means formed in said trunk means.

15. The toy tree of claim 1 wherein a plurality of side opening means are spaced around said trunk means and each of said side opening means is in communication with said enclosed chute means in said hollow trunk means.

16. The toy tree of claim 1 wherein said base means, said trunk means and said lid means are constructed of a molded plastic material.

* * * * *